US012221715B2

(12) United States Patent
Shibata

(10) Patent No.: US 12,221,715 B2
(45) Date of Patent: Feb. 11, 2025

(54) MICROPOROUS PLATING SOLUTION AND METHOD OF USING THIS PLATING SOLUTION TO PERFORM MICROPOROUS PLATING ON OBJECT TO BE PLATED

(71) Applicant: JCU CORPORATION, Taito-ku (JP)

(72) Inventor: Kana Shibata, Kanagawa (JP)

(73) Assignee: JCU CORPORATION, Taito-ku (JP)

( * ) Notice: Subject to any disclaimer, the term of this patent is extended or adjusted under 35 U.S.C. 154(b) by 54 days.

(21) Appl. No.: 17/438,149

(22) PCT Filed: Mar. 3, 2020

(86) PCT No.: PCT/JP2020/008897
§ 371 (c)(1),
(2) Date: Sep. 10, 2021

(87) PCT Pub. No.: WO2020/184289
PCT Pub. Date: Sep. 17, 2020

(65) Prior Publication Data
US 2022/0213606 A1 Jul. 7, 2022

(30) Foreign Application Priority Data
Mar. 12, 2019 (JP) ..... 2019-044556

(51) Int. Cl.
*C25D 3/12* (2006.01)
*C25D 3/06* (2006.01)
*C25D 5/00* (2006.01)

(52) U.S. Cl.
CPC ..... *C25D 3/12* (2013.01); *C25D 3/06* (2013.01); *C25D 5/623* (2020.08)

(58) Field of Classification Search
CPC ... C25D 3/12; C25D 3/14; C25D 3/16; C25D 3/18; C25D 5/623
USPC ..... 205/112, 271, 109
See application file for complete search history.

(56) References Cited

U.S. PATENT DOCUMENTS

2012/0052319 A1 3/2012 Sugawara et al.
2015/0299482 A1* 10/2015 Hemmes ..... D21H 19/40 524/47

FOREIGN PATENT DOCUMENTS

CN 103991916 A * 8/2014 ..... C02F 1/00
GB 2036800 A * 7/1980 ..... C25D 3/16
JP 3-291395 A 12/1991
JP 4-371597 A 12/1992
(Continued)

OTHER PUBLICATIONS

Wu et al., "Enhanced Coagulation for Treating Slightly Polluted Algae-Containing Surface Water Combining Polyaluminum Chloride (PAC) with Diatomite," Desalination (Sep. 15, 2011), vol. 279, Nos. 1-3, pp. 140-145. (Year: 2011).*
(Continued)

*Primary Examiner* — Edna Wong
(74) *Attorney, Agent, or Firm* — Oblon, McClelland, Maier & Neustadt, L.L.P.

(57) ABSTRACT

A microporous plating solution characterized by containing nonconductive particles and polyaluminum chloride allows for easy preparation of positively charged nonconductive particles and is highly stable. Then, a method for performing microporous plating on an object to be plated, characterized by plating the object to be plated in the microporous plating solution results in a favorable number of micropores in the plating.

11 Claims, 4 Drawing Sheets

(56) References Cited

FOREIGN PATENT DOCUMENTS

| | | | | | |
|---|---|---|---|---|---|
| JP | 10-251870 | A | | 9/1998 | |
| JP | 2005144998 | A | * | 6/2005 | ..... B41J 2/01 |
| JP | 2010-185116 | A | | 8/2010 | |
| JP | 2013-125274 | A | | 6/2013 | |
| JP | 2016-505720 | A | | 2/2016 | |

OTHER PUBLICATIONS

International Search Report issued on May 26, 2020 in PCT/JP2020/008897 filed on Mar. 3, 2020, 2 pages.
Sadeghi et al., "Performance of polyaluminum chloride on removal of hexavalent chromium from synthetic wastewater", 2013, 8 pages, XP055936465.
Extended European Search Report issued Jul. 8, 2022 in European Patent Application No. 20771139.1, 8 pages.
Office Action issued Sep. 6, 2023, in corresponding Japanese Patent Application No. 2021-504951 (with English Translation), 8 pages.

* cited by examiner

MICROPOROUS PLATING SOLUTION AND METHOD OF USING THIS PLATING SOLUTION TO PERFORM MICROPOROUS PLATING ON OBJECT TO BE PLATED

TECHNICAL FIELD

The present invention relates to a microporous plating solution containing nonconductive particles, and a method for performing microporous plating on an object to be plated using the plating solution.

BACKGROUND ART

Heretofore, chromium plating has been used as decorative plating for automobile parts, faucet fittings, etc. However, since the chromium plating does not deposit uniformly and pores are opened in the film, a corrosion current is concentrated at one point only with the chromium plating film. Therefore, in general, multilayer nickel is often used under the chromium plating for improving corrosion resistance.

Multilayer nickel is composed of semi-bright nickel plating, high sulfur-content nickel strike plating, bright nickel plating, and microporous plating from the bottom, but it is microporous plating that particularly contributes to the improvement of corrosion resistance. Due to the presence of the microporous plating film, a large number of invisible micropores can be formed on the surface layer of the chromium plating so as to disperse the corrosion current, and thus, the corrosion resistance can be improved (PTL 1).

As a technique for forming such micropores in plating film, it is known that electroplating is performed using a plating solution containing nonconductive particles such as silica particles positively charged with aluminum hydroxide. (PTL 2). In this technique, sodium aluminate (NaAlO2) is used as an aluminum compound that forms aluminum hydroxide in a plating solution, however, it is also known that as such an aluminum compound, aluminum sulfate, chloride, or chloride anhydride, or the like is used.

However, when the nonconductive particles positively charged by such a conventional technique are prepared in advance, the particles solidify, and therefore, it is necessary to add the particles separately every time upon use.

CITATION LIST

Patent Literature

PTL 1: JP-A-03-291395
PTL 2: JP-A-04-371597

Non Patent Literature

NPL 1: "Prevention of Surface Corrosion of Microporous Chromium Plating", Takaaki Koga, Journal of the Surface Finishing Society of Japan, Vol. 28, No. 11, pp. 522-527 (1981)

SUMMARY OF INVENTION

Technical Problem

Therefore, an object of the present invention is to provide a microporous plating solution and a plating method that allow for easy preparation of positively charged nonconductive particles, are highly stable, and result in a favorable number of micropores formed in plating film.

Solution to Problem

The present inventors conducted intensive studies to achieve the above-mentioned object, and as a result, they found that the above-mentioned object can be achieved by using a specific aluminum compound that has not been used so far when positively charging the nonconductive particles, and thus completed the present invention.

That is, the present invention is directed to a microporous plating solution, characterized by containing nonconductive particles and polyaluminum chloride.

In addition, the present invention is directed to an additive for microporous plating, characterized by containing nonconductive particles and polyaluminum chloride.

Further, the present invention is directed to an additive kit for microporous plating, separately containing the following (a) and (b):

(a) nonconductive particles; and (b) polyaluminum chloride.

Still further, the present invention is directed to a method for performing microporous plating on an object to be plated, characterized by electroplating the object to be plated in the above-mentioned microporous plating solution.

Yet still further, the present invention is directed to a method for controlling the number of micropores in plating, characterized in that when plating is performed on an object to be plated in the above-mentioned microporous plating solution, the basicity of polyaluminum chloride contained in the microporous plating solution is changed.

Advantageous Effects of Invention

The microporous plating solution of the present invention allows for easy preparation of positively charged nonconductive particles and is highly stable, and when plating is performed using the solution, also a favorable number of micropores formed in the plating film is yielded.

In addition, the number of micropores in plating can also be controlled by changing the basicity of polyaluminum chloride used in the microporous plating solution of the present invention.

DESCRIPTION OF EMBODIMENTS

Figure 1:
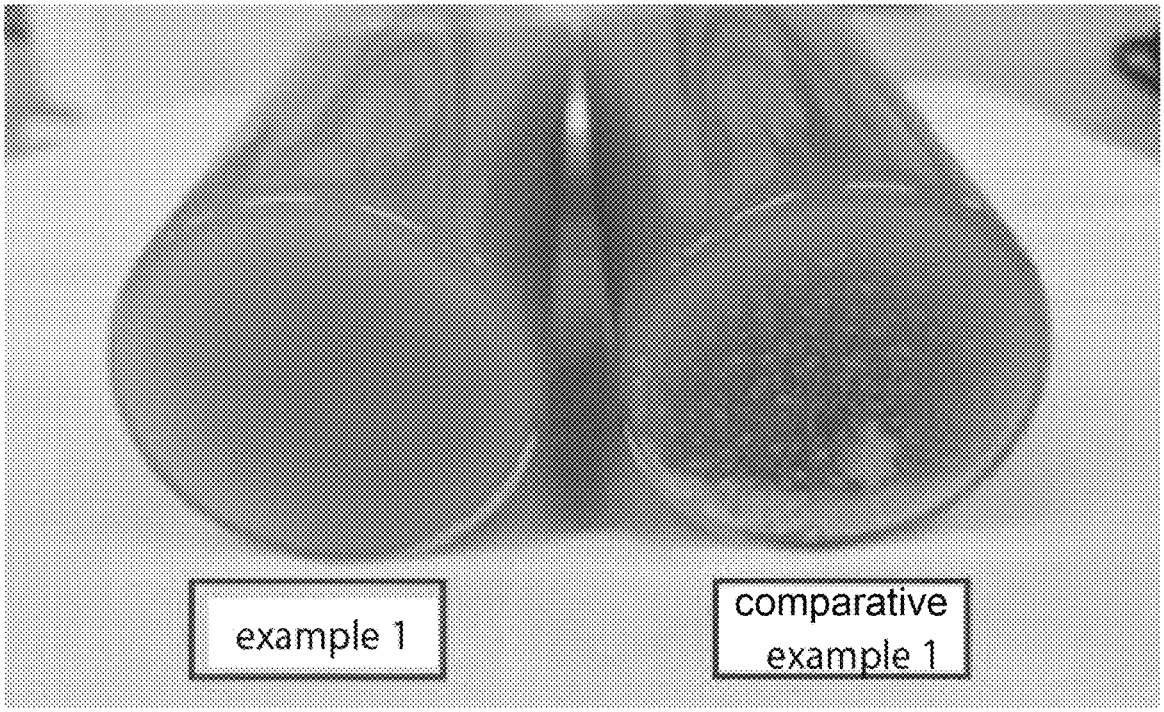
FIG. 1 is a view showing the results of Test Example 1 (right: an additive for microporous plating of Comparative Example 1, left: an additive for microporous plating of Example 1).

The microporous plating solution of the present invention (hereinafter referred to as "the plating solution of the present invention") contains nonconductive particles and polyaluminum chloride.

The nonconductive particles used in the plating solution of the present invention are not particularly limited, and examples thereof include oxides, nitrides, sulfides, and inorganic salts of silicon, barium, zirconium, aluminum, and titanium. Among these, oxides such as silica (silicon dioxide) and zirconia (zirconium dioxide), and inorganic salts such as barium sulfate are preferred. Among these, one or more types can be used. As such nonconductive particles, for example, a commercially available product such as MP POWDER 308 or MP POWDER 309A of JCU Corporation can also be used. The average particle diameter of these nonconductive particles is not particularly limited, but is, for example, from 0.1 to 10 μm, and preferably from 1.0 to 3.0 μm. Note that the average particle diameter is a value measured by a zeta potential/particle diameter/molecular weight measurement system ELSZ-2000 manufactured by Otsuka Electronics Co., Ltd.

The content of the nonconductive particles in the plating solution of the present invention is not particularly limited, but is, for example, from 0.01 to 10 wt % (hereinafter, simply referred to as "%"), and preferably from 0.05 to 10%.

Polyaluminum chloride used in the plating solution of the present invention is represented by the following formula. The basicity of polyaluminum chloride is not particularly limited, but is, for example, from 50 to 65. Further, the basicity is a numerical value represented by n/6×100(%) in the following formula, and can be calculated from an absorbance using the bicinchoninic acid method. Note that when the basicity of polyaluminum chloride used in the plating solution of the present invention is low, the number of micropores in plating increases, and when the basicity is high, the number of micropores decreases, and therefore, the number of micropores can be controlled by appropriately selecting the basicity of polyaluminum chloride.

$$[Al_2(OH)_nCl_{6-n}]_m \quad \text{[Chem. 1]}$$

In the formula, n is an integer of 1 or more and 5 or less, and m is an integer of 10 or less.

When polyaluminum chloride is incorporated in the plating solution of the present invention, polyaluminum chloride in the form of a powder may be added, or for example, a commercially available product, which is in the form of an aqueous solution at about 10% in terms of aluminum oxide, such as Taipac series of Taimei Chemicals Co., Ltd., or PAC of Nankai Chemical Co., Ltd. may be added. Such polyaluminum chloride may be added as it is or after being appropriately diluted or the like.

The content of polyaluminum chloride in the plating solution of the present invention is not particularly limited, but is, for example, preferably from 0.06 to 50.0%, and more preferably from 0.06 to 40% in terms of aluminum oxide.

The plating solution of the present invention need only contain nonconductive particles and polyaluminum chloride in a plating solution serving as a base. The plating solution serving as a base is not particularly limited, and for example, an electrolytic nickel plating solution such as a Watts bath or a sulfamate bath, a trivalent chromium plating solution such as a sulfate bath or a chloride bath, an electroless nickel plating solution using a hypophosphite as a reducing agent, an alloy electroplating solution such as a tin-nickel alloy electroplating bath, a tin-cobalt alloy electroplating bath, or a nickel-phosphorus alloy electroplating bath, and the like are exemplified. Among these plating solutions, an electrolytic nickel plating solution is preferred.

Note that the plating solution serving as a base is preferably one having a specific gravity of 1.0 to 1.6 g/cm$^3$ and more preferably one having a specific gravity of 1.1 to 1.4 g/cm$^3$ in order to maintain formation of uniform micropores.

Further, the pH of the plating solution serving as a base is not particularly specified, but is desirably set to the same pH as that at the time of plating described later.

It is preferred that in the plating solution of the present invention, a surfactant is further incorporated from the viewpoint of maintaining the dispersibility. The surfactant is not particularly limited, and examples thereof include nonionic surfactants such as polyethylene glycol, anionic surfactants such as polyoxyethylene alkyl ether sodium sulfate, cationic surfactants such as benzethonium chloride and stearylamine acetate, and amphoteric surfactants such as lauryl betaine and lauryl dimethyl amine oxide. Among these surfactants, one or more types can be used. Among these surfactants, a cationic surfactant that is positively charged or an amphoteric surfactant that exhibits cationicity in the used pH range is preferred.

The content of the surfactant in the plating solution of the present invention is not particularly limited, but is, for example, preferably from 0.001 to 5%, and more preferably from 0.001 to 2%.

It is preferred that in the plating solution of the present invention, a brightener is further incorporated from the viewpoint of improving the appearance and adjusting the electrochemical potential for the purpose of preventing rust. The type of brightener is not particularly limited, and one type or two or more types may be appropriately selected from brighteners suitable for the plating solutions serving as various bases.

The content of the brightener in the plating solution of the present invention is not particularly limited, but is, for example, preferably from 0.01 to 20%, and more preferably from 0.1 to 15%.

In the plating solution of the present invention, for example, a component such as chloral hydrate may be further incorporated in order to adjust the electrochemical potential for the purpose of preventing rust.

Among the plating solutions serving as a base, as the composition of the Watts bath, a composition as described below is exemplified.

Nickel sulfate ($NiSO_4 \cdot 6H_2O$): 240 to 300 g/L
Nickel chloride ($NiCl_2 \cdot 6H_2O$): 30 to 45 g/L
Boric acid ($H_3BO_3$): 30 to 45 g/L As the composition of the sulfamate bath, a composition as described below is exemplified.

Nickel sulfamate ($Ni(SO_3NH_2)_2 \cdot 4H_2O$): 300 to 600 g/L
Nickel chloride ($NiCl_2 \cdot 6H_2O$): 0 to 15 g/L
Boric acid ($H_3BO_3$): 30 to 40 g/L It is preferred that in the electrolytic nickel plating bath such as the Watts bath and the sulfamate bath, a primary brightener and a secondary brightener are further incorporated. Examples of the primary brightener include sulfonamide, sulfonimide, benzenesulfonic acid, and an alkylsulfonic acid. As the primary brightener, for example, MP333 (manufactured by JCU Corporation) or the like is commercially available, and therefore, this may be used. Further, examples of the secondary brightener include 1,4-butynediol and coumarin. The secondary brightener is an organic compound having a functional group as described below (C═O, C═C, C≡N, C═N, C≡N, N—C═S, N═N, —$CH_2$—CH—O). As the secondary brightener, for example, #810 (manufactured by JCU Corporation) or the like is commercially available, and therefore, this may be used. These primary brighteners and secondary brighteners may be used alone or in combination. Further, it is preferred to add the primary brightener at 5 to 15 mL/L and the secondary brightener at about 10 to 35 mL/L.

As the composition of the trivalent chromium plating bath, a composition as described below is exemplified.

<Sulfate Bath>

Basic chromium sulfate ($Cr(OH)SO_4$): 50 to 80 g/L

Diammonium tartrate ($[CH(OH)COONH_4]_2$): 25 to 35 g/L

Potassium sulfate ($K_2SO_4$): 5 to 150 g/L

Ammonium sulfate ($(NH_4)_2SO_4$): 5 to 150 g/L

Boric acid ($H_3BO_3$): 60 to 80 g/L

It is preferred that in the trivalent chromium plating bath such as the above-mentioned sulfate bath, a sulfur-containing organic compound is further incorporated. As the sulfur-containing organic compound, it is preferred to use saccharin or a salt thereof and a sulfur-containing organic compound having an allyl group in combination. Examples of the saccharin or a salt thereof include saccharin and sodium saccharinate. Further, examples of the sulfer-containing organic compound having an allyl group include sodium allylsulfonate, allylthiourea, sodium 2-methylallylsulfonate, and allyl isothiocyanate. As the sulfur-containing organic compound having an allyl group, one type or two types may be combined, and it is preferred to use sodium allylsulfonate and allylthiourea individually by itself or in combination. A preferred combination of the sulfur-containing organic compounds is sodium saccharinate and sodium allylsulfonate. Further, the content of the sulfur-containing organic compound is, for example, from 0.5 to 10 g/L, and preferably from 2 to 8 g/L.

<Chloride Bath>

Basic chromium sulfate ($Cr(OH)SO_4$): 50 to 80 g/L

Ammonium formate ($HCOONH_4$): 13 to 22 g/L

Potassium chloride ($KCl$): 5 to 170 g/L

Ammonium chloride ($NH_4Cl$): 90 to 100 g/L

Ammonium bromide ($NH_4Br$): 5.4 to 6.0 g/L

Boric acid ($H_3BO_3$): 60 to 80 g/L

As the composition of the electroless nickel plating bath, a composition as described below is exemplified.

Nickel sulfate ($NiSO_4 \cdot 6H_2O$): 15 to 30 g/L

Sodium phosphinate ($NaPH_2O_2 \cdot H_2O$): 20 to 30 g/L

Lactic acid ($CH_3CH(OH)COOH$): 20 to 35 g/L

Malic acid ($HOOCCH(OH)CH_2COOH$): 10 to 20 g/L

Citric acid ($HOOCCH_2C(OH)(COOH)CH_2COOH$): 10 to 20 g/L

Propionic acid ($CH_3CH_2COOH$): 5 to 10 g/L

As the composition of the tin-nickel alloy electroplating bath, a composition as described below is exemplified.

Nickel chloride ($NiCl_2 \cdot 6H_2O$): 250 to 300 g/L

Tin chloride ($SnCl_2$): 40 to 50 g/L

Ammonium chloride ($NH_4Cl$): 90 to 110 g/L

Ammonium fluoride ($NH_4F$): 55 to 65 g/L

As the composition of the tin-cobalt alloy electroplating bath, a composition as described below is exemplified.

Cobalt chloride ($CoCl_2$): 360 to 440 g/L

Stannous fluoride ($SnF_2$): 60 to 72 g/L

Ammonium fluoride ($NH_4F$): 25 to 35 g/L

In the above-mentioned tin-cobalt alloy electroplating bath, the primary brightener as listed above at 5 to 15 mL/L and the secondary brightener as listed above at 10 to 35 mL/L may be further incorporated.

As the composition of the nickel-phosphorus alloy electroplating bath, a composition as described below is exemplified.

Nickel sulfate ($NiSO_4 \cdot 6H_2O$): 150 to 200 g/L

Sodium chloride ($NaCl$): 18 to 22 g/L

Boric acid ($H_3BO_3$): 18 to 22 g/L

Sodium hypophosphite ($NaH_2PO_2 \cdot H_2O$): 20 to 30 g/L

Orthophosphoric acid ($H_3PO_4$): 40 to 50 g/L

In the above-mentioned nickel-phosphorus alloy electroplating bath, the primary brightener as listed above at 5 to 15 mL/L and the secondary brightener as listed above at 10 to 35 mL/L may be further incorporated.

A method for preparing the plating solution of the present invention is not particularly limited because the nonconductive particles are positively charged merely by incorporating the nonconductive particles and polyaluminum chloride in the plating solution serving as a base, however, preferably, an additive for microporous plating containing the nonconductive particles and polyaluminum chloride or an additive kit for microporous plating separately containing the following (a) and (b), or the like may be added to and mixed in the plating solution serving as a base.

(a) nonconductive particles (b) polyaluminum chloride

In the case of the additive for microporous plating containing the nonconductive particles and polyaluminum chloride, for example, the nonconductive particles are added to and mixed in a portion of the plating solution serving as a base, or water or the like, and thereafter, polyaluminum chloride may be added thereto and mixed therein. Such an additive for microporous plating does not cause solidification, and therefore can be stably stored and is suitable for replenishment when consuming the nonconductive particles as compared with a case where a conventional aluminum compound that forms aluminum hydroxide is used.

Further, in the additive kit for microporous plating, (a) and (b) may be used as they are or diluted with the plating solution serving as a base, or water or the like.

By using the plating solution of the present invention in place of the plating solution used for forming micropores in a conventional method for performing microporous plating on an object to be plated, microporous plating having a better number of micropores than the conventional method can be achieved.

The object to be plated that can be plated with the plating solution of the present invention is not particularly limited as long as it can be plated, and examples thereof include metals such as copper, nickel, and zinc, and resins such as ABS, PC/ABS, and PP. Further, the plating conditions of the plating solution of the present invention may be the same conditions as those of a conventional method for performing microporous plating on an object to be plated. For example, conditions in which the temperature is from 50 to 55° C., the pH is from 4.0 to 5.5, and the current density is from 3 to 4 $A/dm^2$, and the like are exemplified.

Specifically, in order to obtain microporous nickel plating using the plating solution of the present invention, for example, semi-bright nickel plating, high sulfur-content nickel strike plating, and bright nickel plating are performed in this order, and then, plating is performed in the plating solution of the present invention using an electrolytic nickel plating solution as a base, and finally, hexavalent or trivalent chromium plating need only be performed. Further, after performing trivalent chromium plating, electrolytic chromate treatment may be performed.

The lower layer of microporous nickel plating is bright nickel plating, high sulfur-content nickel strike plating, and semi-bright nickel plating. It is preferred that the sulfur content of the bright nickel plating film is set to 0.05% to 0.15%, the sulfur content of the high sulfur-content nickel strike plating film is set to 0.1 to 0.25%, and the sulfur content of the semi-bright nickel plating film is set to less than 0.005%.

Further, it is preferred that the bright nickel plating film is less noble than the semi-bright nickel plating film by about 60 to 200 mV, and the bright nickel plating film is more noble than the high sulfur-content nickel strike plating film by about 10 to 50 mV, and the bright nickel plating film is less noble than the microporous nickel plating film by about 10 to 120 mV. Such potential adjustment can be performed by a method as described in JP-A-5-171468.

The semi-bright nickel plating bath used to obtain the semi-bright nickel plating film is not particularly limited, but for example, it is preferred to add a primary brightener and a secondary brightener as listed above to a known nickel plating bath. As the primary brightener for such semi-bright nickel plating, for example, CF-NIIA (manufactured by JCU Corporation) or the like is commercially available, and therefore, this may be used. Further, as the secondary brightener for semi-bright nickel plating, for example, CF-24T (manufactured by JCU Corporation) or the like is commercially available, and therefore, this may be used. As a preferred semi-bright nickel plating bath, the following bath is exemplified. Further, the plating conditions are not particularly limited.

<Semi-Bright Nickel Plating Bath>

Nickel sulfate ($NiSO_4 \cdot 6H_2O$): 200 to 350 g/L
Nickel chloride ($NiCl_2 \cdot 6H_2O$): 30 to 45 g/L
Boric acid ($H_3BO_3$): 30 to 45 g/L
Primary brightener: 0.6 to 1.6 mL/L
Secondary brightener: 0.3 to 1.2 mL/L The high sulfur-content nickel strike plating bath is not particularly limited, but for example, it is preferred to add a primary brightener as listed above to a known nickel plating bath in order to make the sulfur content high. As the primary brightener for such high sulfur-content nickel strike plating bath, for example, TRI-STRIKE (manufactured by JCU Corporation) or the like is commercially available, and therefore, this may be used. Further, as a preferred high sulfur-content nickel strike plating bath, the following bath is exemplified. The plating conditions are not particularly limited.

<High Sulfur-Content Nickel Strike Plating Bath>

Nickel sulfate ($NiSO_4 \cdot 6H_2O$): 240 to 320 g/L
Nickel chloride ($NiCl_2 \cdot 6H_2O$): 67 to 110 g/L
Boric acid ($H_3BO_3$): 34 to 38 g/L
Primary brightener: 10 to 25 mL/L The bright nickel plating bath is not particularly limited as long as a film that becomes electrochemically less noble than the semi-bright nickel plating film can be formed, but for example, it is preferred to add a primary brightener and a secondary brightener as listed above to a known nickel plating bath. As the primary brightener for such bright nickel plating, for example, #83-S, #83 (manufactured by JCU Corporation), or the like is commercially available, and therefore, this may be used. Further, as the secondary brightener for bright nickel plating, for example, #810 (manufactured by JCU Corporation) or the like is commercially available, and therefore, this may be used. As a preferred bright nickel plating bath, the following bath is exemplified. Further, the plating conditions are not particularly limited.

<Bright Nickel Plating Bath>

Nickel sulfate ($NiSO_4 \cdot 6H_2O$): 200 to 300 g/L
Nickel chloride ($NiCl_2 \cdot 6H_2O$): 35 to 60 g/L
Boric acid ($H_3BO_3$): 35 to 60 g/L
Primary brightener: 5 to 10 mL/L
Secondary brightener: 10 to 35 mL/L As a preferred plating solution of the present invention, the following solution is exemplified. Further, the plating conditions are not particularly limited, and may be conventional plating conditions of microporous plating.

<Microporous Nickel Plating Bath>

Nickel sulfate ($NiSO_4 \cdot 6H_2O$): 240 to 320 g/L
Nickel chloride ($NiCl_2 \cdot 6H_2O$): 35 to 60 g/L
Boric acid ($H_3BO_3$): 35 to 60 g/L
Primary brightener: 5 to 15 mL/L
Secondary brightener: 10 to 35 mL/L
Silicon dioxide (average particle diameter: 1.5 μm): 0.1 to 10 g/L
Polyaluminum chloride (in terms of aluminum oxide) *: 0.04 to 0.4 g/L, *: basicity: 55 to 65

As a hexavalent chromium plating bath, a known hexavalent chromium plating bath can be used, but it is preferred to further add a catalyst. Examples of the catalyst include sodium silicofluoride and strontium silicofluoride. Further, as the catalyst for hexavalent chromium plating, for example, ECR-300L (manufactured by JCU Corporation) or the like is commercially available, and therefore, this may be used. As a preferred hexavalent chromium plating bath, the following bath is exemplified. Further, the plating conditions are not particularly limited.

<Hexavalent Chromium Plating Bath>

Chromic anhydride ($CrO_3$): 200 to 250 g/L
Sulfuric acid ($H_2SO_4$): 0.8 to 1 g/L
Sodium silicofluoride: 5 to 10 g/L A trivalent chromium plating bath is not particularly limited, and may be either a sulfate bath or a chloride bath. As a preferred trivalent chromium plating bath, the following bath is exemplified. Further, the plating conditions are not particularly limited.

<Trivalent Chromium Plating Bath>

Basic chromium sulfate ($Cr(OH)SO_4$): 50 to 80 g/L
Ammonium formate ($HCOONH_4$): 13 to 22 g/L
Potassium chloride (KCl): 5 to 170 g/L
Ammonium chloride ($NH_4Cl$): 90 to 100 g/L
Ammonium bromide ($NH_4Br$): 5.4 to 6 g/L
Boric acid ($H_3BO_3$): 60 to 80 g/L The thus obtained microporous plating film has excellent corrosion resistance, and therefore is suitable for applications such as automobile parts and faucet fittings.

EXAMPLES

Hereinafter, the present invention will be described in detail with reference to Examples, but the present invention is by no means limited to these Examples and the like.

Example 1

Preparation of Additive for Microporous Plating:

A Watts bath having the following composition was prepared, and silicon dioxide was added thereto at 50 g/L, followed by stirring and mixing. Subsequently, polyaluminum chloride (Taimei Chemicals Co., Ltd., Taipac 6010, basicity: 63) was added thereto at 2 g/L in terms of aluminum oxide, followed by stirring and mixing, whereby an additive for microporous plating containing positively charged nonconductive particles was obtained.

<Watts Bath>

Nickel sulfate ($NiSO_4 \cdot 6H_2O$): 260 g/L
Nickel chloride ($NiCl_2 \cdot 6H_2O$): 45 g/L
Boric acid ($H_3BO_3$): 45 g/L
Specific gravity: 1.200

Comparative Example 1

Preparation of Additive for Microporous Plating:

A Watts bath having the same composition as that used in Example 1 was prepared, and silicon dioxide was added thereto at 50 g/L, followed by stirring and mixing. Subsequently, aluminic acid which is an aluminum compound that forms aluminum hydroxide was added thereto at 2 g/L in terms of aluminum oxide, followed by stirring and mixing, whereby an additive for microporous plating containing charged silica particles was obtained.

Test Example 1

Dispersibility Test:

The additives for microporous plating prepared in Example 1 and Comparative Example 1 were each placed in a glass bottle container, and left for 1 week. When the containers after being left were laid on its side, it could be confirmed that the additive for microporous plate of Comparative Example 1 solidified and stuck to the bottom of the container (right in FIG. 1). On the other hand, it could be confirmed that the additive for microporous plating of Example 1 was well dispersed, did not solidify, and did not stick to the bottom of the container (left in FIG. 1).

Example 2

Preparation of Microporous Plating Solution:

The additive for microporous plating prepared in Example 1 was added at 15 mL/L to a Watts bath having the following composition, whereby a microporous plating solution was prepared.

<Watts Bath>

Nickel sulfate ($NiSO_4 \cdot 6H_2O$): 260 g/L
Nickel chloride ($NiCl_2 \cdot 6H_2O$): 45 g/L
Boric acid ($H_3BO_3$): 45 g/L
Brightener #810*: 3 mL/L
Brightener MP333*: 10 mL/L
Bath temperature: 55° C.
Specific gravity: 1.205

*: manufactured by JCU Corporation

Comparative Example 2

Preparation of Microporous Plating Solution:

The additive for microporous plating prepared in Comparative Example 1 was added at 15 mL/L to a Watts bath having the same composition as that used in Example 2, whereby a microporous plating solution was prepared.

Test Example 2

Figure 2:
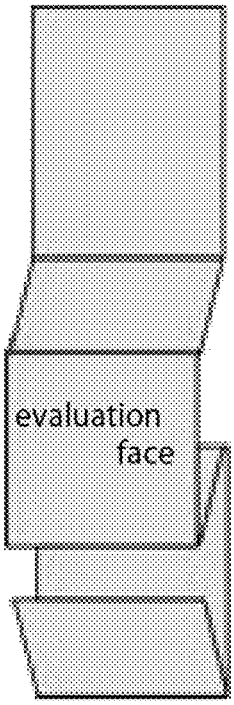
FIG. 2 is a view showing the shape of a bent cathode test piece (brass) used in Test Example 2, and a portion for which the number of micropores was measured.

Production of Microporous Plated Product:

A bent cathode test piece (brass: manufactured by YAMAMOTO-MS Co., Ltd.) having a shape shown in FIG. 2 was used as a test piece, and a microporous plated product was produced by the following step.

(Degreasing/Acid Activity)

The test piece was treated with SK-144 (manufactured by JCU Corporation) for 5 minutes to degrease, and then treated with V-345 (manufactured by JCU Corporation) for 30 seconds to perform acid activity.

(Bright Nickel Plating)

The test piece having been subjected to the degreasing and acid activity treatments in the above was plated at 4 $A/dm^2$ for 3 minutes in the following nickel plating solution.

<Bright Nickel Plating Bath>

Nickel sulfate ($NiSO_4 \cdot 6H_2O$): 260 g/L
Nickel chloride ($NiCl_2 \cdot 6H_2O$): 45 g/L
Boric acid ($H_3BO_3$): 45 g/L
Brightener #810*: 3 mL/L
Brightener #83*: 10 mL/L

*: manufactured by JCU Corporation (Microporous Plating)

The test piece having been subjected to bright plating was plated at 3 $A/dm^2$ for 3 minutes in the microporous plating solution prepared in Example 2 or Comparative Example 2.

(Chromium Plating)

The test piece having been subjected to the above-mentioned microporous plating was plated at 10 $A/dm^2$ for 3 minutes in a hexavalent chromium plating solution having the following composition.

<Hexavalent Chromium Plating Bath>

Chromic anhydride ($CrO_3$) 250 g/L
Sulfuric acid ($H_2SO_4$) 1 g/L
Additive ECR 300L*: 10 mL/L
MISTSHUT NP*: 0.1 mL/L

*: manufactured by JCU Corporation (Measurement of Number of Micropores 1)

The test piece after being subjected to chromium plating was immersed for 3 minutes in a copper sulfate plating solution having the following composition, and thereafter, plated at 0.5 $A/dm^2$ for 3 minutes in the copper sulfate plating solution.

<Copper Sulfate Plating Bath>

Copper sulfate ($CuSO_4 \cdot 5H_2O$): 220 g/L
Sulfuric acid ($H_2SO_4$): 50 g/L
Hydrochloric acid (HCl): 0.15 mL/L (Measurement of Number of Micropores 2)

After copper sulfate plating, the test piece was gently washed with water, and dried with air, and then, the number of micropores in the plating film was measured. Note that the measurement of the number of micropores was performed for the evaluation face of the test piece, and was performed using a microscope VHX-200 manufactured by Keyence Corporation. The measurement results of the number of micropores of Example 2 and Comparative Example 2 are shown in Table 1.

TABLE 1

| | Example 2 | Comparative Example 2 |
|---|---|---|
| Number of micropores on evaluation face (micropores/$cm^2$) | 86800 | 27604 |

As apparent from Table 1, even if the amount in terms of aluminum oxide in the plating solution is the same, a larger number of micropores was obtained in Example 2 using polyaluminum chloride.

Test Example 3

Performance Over Time of Additive:

The additive prepared in Example 1 was added at 10 mL/L to a Watts bath having the same composition as that used in Example 2, and a difference in the performance immediately after preparation and one month after preparation was compared. Plating was performed in the same manner as in Test Example 2, and the number of micropores (micropores/$cm^2$) was measured also in the same manner as in Test Example 2. The results are shown in Table 2.

TABLE 2

| | Immediately after preparation | One month after preparation |
|---|---|---|
| Number of micropores on evaluation face (micropores/$cm^2$) | 36805 | 36381 |

As apparent from Table 2, the number of micropores was almost constant immediately after preparation and one month after preparation. These results indicated that the additive prepared in Example 1 can maintain stable performance even after one month.

Example 3

Preparation of Microporous Plating Solution:

To 267 mL of a Watts bath having the same composition as that used in Example 2, silicon dioxide (average particle diameter: 1.5 μm) was added at 1 g/L and polyaluminum chloride (Taipack, manufactured by Taimei Chemicals Co., Ltd., basicity: 55) was added at 0.04 g/L in terms of aluminum oxide, whereby a microporous plating solution was prepared.

Example 4

Preparation of Microporous Plating Solution:

To 267 mL of a Watts bath having the same composition as that used in Example 2, silicon dioxide (average particle diameter: 1.5 μm) was added at 1 g/L and polyaluminum chloride (Alphaine 83, manufactured by Taimei Chemicals Co., Ltd., basicity: 83) was added at 0.04 g/L in terms of aluminum oxide, whereby a microporous plating solution was prepared.

Example 5

Preparation of Microporous Plating Solution:

To 267 mL of a Watts bath having the same composition as that used in Example 2, silicon dioxide (average particle diameter: 1.5 μm) was added at 1 g/L and polyaluminum chloride (PAC, manufactured by Nankai Chemical Co., Ltd., basicity: 53) was added at 0.04 g/L in terms of aluminum oxide, whereby a microporous plating solution was prepared.

Example 6

Preparation of Microporous Plating Solution:

To 267 mL of a Watts bath having the same composition as that used in Example 2, silicon dioxide (average particle diameter: 1.5 μm) was added at 1 g/L and polyaluminum chloride (Taipack 6010, manufactured by Taimei Chemicals Co., Ltd., basicity: 63) was added at 0.04 g/L in terms of aluminum oxide, whereby a microporous plating solution was prepared.

Test Example 4

Comparison of Basicity of Polyaluminum Chloride:

A brass plate (Hull cell plate) having a size of 60 cm×10 cm was used as a test piece. The test piece was subjected to the same procedure as in Test Example 2 except that any of the microporous plating solutions prepared in Examples 3 to 6 was used as the microporous plating solution, and a microporous plated product was produced by setting the current value to 2 A.

Note that the measurement of the number of micropores (micropores/$cm^2$) was performed for 6 A/$dm^2$, 3 A/$dm^2$, and 1 A/$dm^2$ portions of the Hull cell plate, and was performed using a microscope VHX-200 manufactured by Keyence Corporation. The results are shown in Table 3.

TABLE 3

| | Example 3 | Example 4 | Example 5 | Example 6 |
|---|---|---|---|---|
| Basicity | 55 | 83 | 53 | 63 |
| Number of micropores in 6 ASD portion (micropores/$cm^2$) | 57843 | 938 | 111800 | 18603 |
| Number of micropores in 3 ASD portion (micropores/$cm^2$) | 55476 | 424 | 109800 | 19028 |
| Number of micropores in 1 ASD portion (micropores/$cm^2$) | 28832 | 67 | 44644 | 10295 |

As apparent from Table 3, it was found that the number of micropores can be controlled by the difference in basicity even when using the same polyaluminum chloride. Further, it can be said that a suitable basicity for corrosion resistance is from 50 to 65.

Example 7

Preparation of Additive for Microporous Plating:

To a solution having the following composition, silicon dioxide (average particle diameter: 1.5 μm) was added at 50 g/L, followed by stirring and mixing. Subsequently, polyaluminum chloride (Taimei Chemicals Co., Ltd., Taipac 6010, basicity: 63) was added thereto at 2 g/L in terms of aluminum oxide, followed by stirring and mixing, whereby an additive for microporous plating containing positively charged nonconductive particles was obtained.

Nickel sulfate ($NiSO_4 \cdot 6H_2O$): 260 g/L

Boric acid ($H_3BO_3$): 45 g/L

Specific gravity: 1.162

Example 8

Preparation of Additive for Microporous Plating:

To a solution having the following composition, silicon dioxide (average particle diameter: 1.5 μm) was added at 50 g/L, followed by stirring and mixing. Subsequently, polyaluminum chloride (Taimei Chemicals Co., Ltd., Taipac 6010, basicity: 63) was added thereto at 2 g/L in terms of aluminum oxide, followed by stirring and mixing, whereby an additive for microporous plating containing positively charged nonconductive particles was obtained.

Nickel chloride ($NiCl_2 \cdot 6H_2O$): 260 g/L

Boric acid ($H_3BO_3$): 45 g/L

Specific gravity: 1.133

Example 9

Preparation of Additive for Microporous Plating:

To a solution having the following composition, silicon dioxide (average particle diameter: 1.5 μm) was added at 50 g/L, followed by stirring and mixing. Subsequently, polyaluminum chloride (Taimei Chemicals Co., Ltd., Taipac 6010, basicity: 63) was added thereto at 2 g/L in terms of aluminum oxide, followed by stirring and mixing, whereby an additive for microporous plating containing positively charged nonconductive particles was obtained.

Nickel sulfate ($NiSO_4 \cdot 6H_2O$): 470 g/L
Nickel chloride ($NiCl_2 \cdot 6H_2O$): 35 g/L
Boric acid ($H_3BO_3$): 40 g/L
Specific gravity: 1.280

Example 10

Preparation of Additive for Microporous Plating:

To a solution having the following composition, silicon dioxide (average particle diameter: 1.5 μm) was added at 50 g/L, followed by stirring and mixing. Subsequently, polyaluminum chloride (Taimei Chemicals Co., Ltd., Taipac 6010, basicity: 63) was added thereto at 2 g/L in terms of aluminum oxide, followed by stirring and mixing, whereby an additive for microporous plating containing positively charged nonconductive particles was obtained.

Water: 1 L/L
Specific gravity: 1.000

Example 11

Preparation of Microporous Plating Solution:

The additive for microporous plating prepared in Example 7 was added at 10 mL/L to 1 L of a Watts bath having the same composition as that used in Example 2, whereby a microporous plating solution was prepared.

Example 12

Preparation of Microporous Plating Solution:

The additive for microporous plating prepared in Example 8 was added at 10 mL/L to 1 L of a Watts bath having the same composition as that used in Example 2, whereby a microporous plating solution was prepared.

Example 13

Preparation of Microporous Plating Solution:

The additive for microporous plating prepared in Example 9 was added at 10 mL/L to 1 L of a Watts bath having the same composition as that used in Example 2, whereby a microporous plating solution was prepared.

Example 14

Preparation of Microporous Plating Solution:

The additive for microporous plating prepared in Example 10 was added at 3 mL/L to 267 mL of a Watts bath having the same composition as that used in Example 2, whereby a microporous plating solution was prepared.

Example 15

Preparation of Microporous Plating Solution:

The additive for microporous plating prepared in Example 1 was added at 3 mL/L to 267 mL of a Watts bath having the same composition as that used in Example 2, whereby a microporous plating solution was prepared.

Test Example 5

Examination of Solvent in Additive:

Microporous plated products were produced in the same manner as in Test Example 2 except that any of the microporous plating solutions prepared in Examples 11 to 13 was used as the microporous plating solution. The number of micropores (micropores/$cm^2$) was also measured in the same manner as in Test Example 2. The results are shown in Table 4.

TABLE 4

| | Example 11 | Example 12 | Example 13 |
|---|---|---|---|
| Number of micropores on evaluation face (micropores/$cm^2$) | 65012 | 44063 | 40468 |

It was found that the number of micropores is different depending on the solvent in the additive even when the addition amount is the same.

Test Example 6

Examination of Solvent in Additive:

Microporous plated products were produced in the same manner as in Test Example 4 except that any of the microporous plating solutions prepared in Examples 14 to 15 was used as the microporous plating solution. The number of micropores (micropores/$cm^2$) was also measured in the same manner as in the Test Example. The results are shown in Table 5.

TABLE 5

| | Example 14 | Example 15 |
|---|---|---|
| Number of micropores in 6 ASD portion (micropores/$cm^2$) | 17956 | 35242 |
| Number of micropores in 3ASD portion (micropores/$cm^2$) | 10161 | 28542 |
| Number of micropores in 1 ASD portion (micropores/$cm^2$) | 3551 | 13958 |

It was found that the number of micropores is different depending on the solvent in the additive even when the addition amount is the same.

Test Example 7

Figure 3:
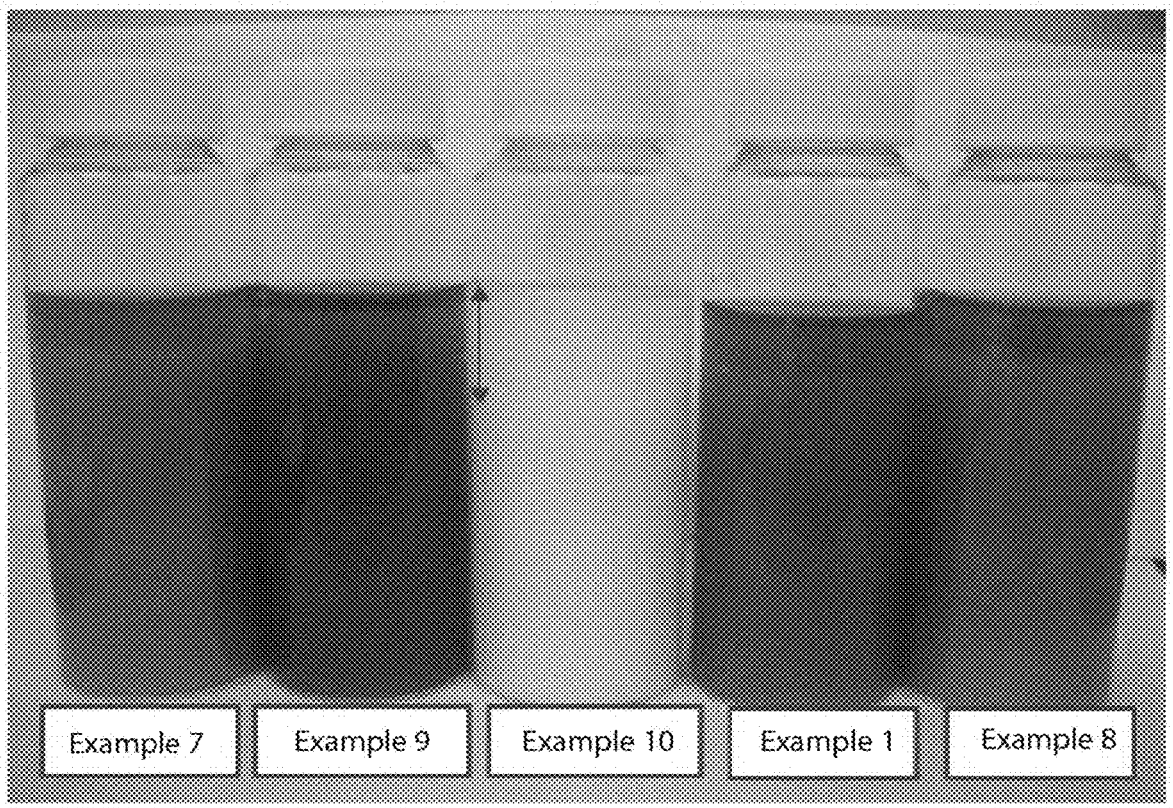
FIG. 3 is a view showing the results of a dispersibility test of Test Example 7.

Sedimentability Test:

The additives for microporous plating prepared in Example 1 and Examples 7 to 10 were each placed in a transparent glass container, and left for 1 hour. When the containers after being left were confirmed, in the additive for microporous plating of Example 10, the positively charged nonconductive particles sedimented faster than in the other samples. On the other hand, in the additive for microporous plating of Example 9, the positively charged nonconductive particles sedimented most slowly (FIG. 3).

Figure 4:
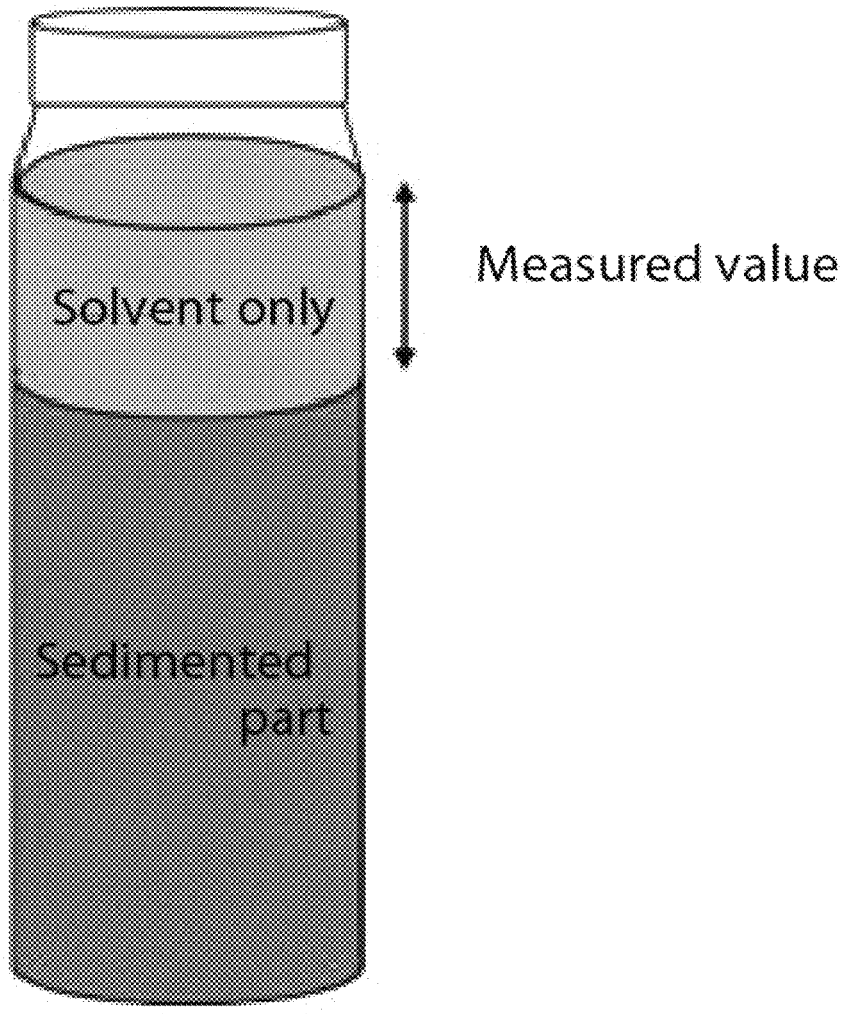
FIG. 4 is a view showing a measured value in Test Example 7.

Subsequently, a height of the sedimented powder was determined by subtracting the height of a portion in which the positively charged nonconductive particles sedimented from the height of the entire solution as shown in FIG. 4. The results are shown in Table 6.

TABLE 6

| | Example 1 | Example 7 | Example 8 | Example 9 | Example 10 |
|---|---|---|---|---|---|
| Measured value (cm) | 1.0 | 1.0 | 1.0 | 0.3 | 2.0 |

It was found that the sedimentation speed is different depending on the solvent in the additive.

Example 16

Preparation of Microporous Plating Solution:

To a Watts bath having the following composition, silicon dioxide (average particle diameter: 1.5 μm) was added at 1 g/L, followed by stirring and mixing. Subsequently, polyaluminum chloride (Taimei Chemicals Co., Ltd., Taipac 6010, basicity: 63) was added thereto at 0.04 g/L in terms of aluminum oxide, followed by stirring and mixing, whereby a microporous plating solution containing positively charged nonconductive particles was obtained.

<Watts Bath>

Nickel sulfate ($NiSO_4 \cdot 6H_2O$): 260 g/L
Nickel chloride ($NiCl_2 \cdot 6H_2O$): 40 g/L
Boric acid ($H_3BO_3$): 40 g/L
Brightener #810*: 3 mL/L
Brightener MP333*: 10 mL/L
Specific gravity: 1.191

*: manufactured by JCU Corporation

Example 17

Preparation of Microporous Plating Solution:

To a Watts bath having the following composition, silicon dioxide (average particle diameter: 1.5 μm) was added at 1 g/L, followed by stirring and mixing. Subsequently, polyaluminum chloride (Taimei Chemicals Co., Ltd., Taipac 6010, basicity: 63) was added thereto at 0.04 g/L in terms of aluminum oxide, followed by stirring and mixing, whereby a microporous plating solution containing positively charged nonconductive particles was obtained.

<Watts Bath>

Nickel sulfate ($NiSO_4 \cdot 6H_2O$): 300 g/L
Nickel chloride ($NiCl_2 \cdot 6H_2O$): 40 g/L
Boric acid ($H_3BO_3$): 40 g/L
Brightener #810*: 3 mL/L
Brightener MP333*: 10 mL/L
Specific gravity: 1.212

*: manufactured by JCU Corporation

Example 18

Preparation of Microporous Plating Solution:

To a Watts bath having the following composition, silicon dioxide (average particle diameter: 1.5 μm) was added at 1 g/L, followed by stirring and mixing. Subsequently, polyaluminum chloride (Taimei Chemicals Co., Ltd., Taipac 6010, basicity: 63) was added thereto at 0.04 g/L in terms of aluminum oxide, followed by stirring and mixing, whereby a microporous plating solution containing positively charged nonconductive particles was obtained.

<Watts Bath>

Nickel sulfate ($NiSO_4 \cdot 6H_2O$): 350 g/L
Nickel chloride ($NiCl_2 \cdot 6H_2O$): 40 g/L
Boric acid ($H_3BO_3$): 40 g/L
Brightener #810*: 3 mL/L
Brightener MP333*: 10 mL/L
Specific gravity: 1.241

*: manufactured by JCU Corporation

Example 19

Preparation of Microporous Plating Solution:

To a Watts bath having the following composition, silicon dioxide (average particle diameter: 1.5 μm) was added at 1 g/L, followed by stirring and mixing. Subsequently, polyaluminum chloride (Taimei Chemicals Co., Ltd., Taipac 6010, basicity: 63) was added thereto at 0.04 g/L in terms of aluminum oxide, followed by stirring and mixing, whereby a microporous plating solution containing positively charged nonconductive particles was obtained.

<Watts Bath>

Nickel sulfate ($NiSO_4 \cdot 6H_2O$): 400 g/L
Nickel chloride ($NiCl_2 \cdot 6H_2O$): 40 g/L
Boric acid ($H_3BO_3$): 40 g/L
Brightener #810*: 3 mL/L
Brightener MP333*: 10 mL/L
Specific gravity: 1.275

*: manufactured by JCU Corporation

Test Example 8

Figure 5:
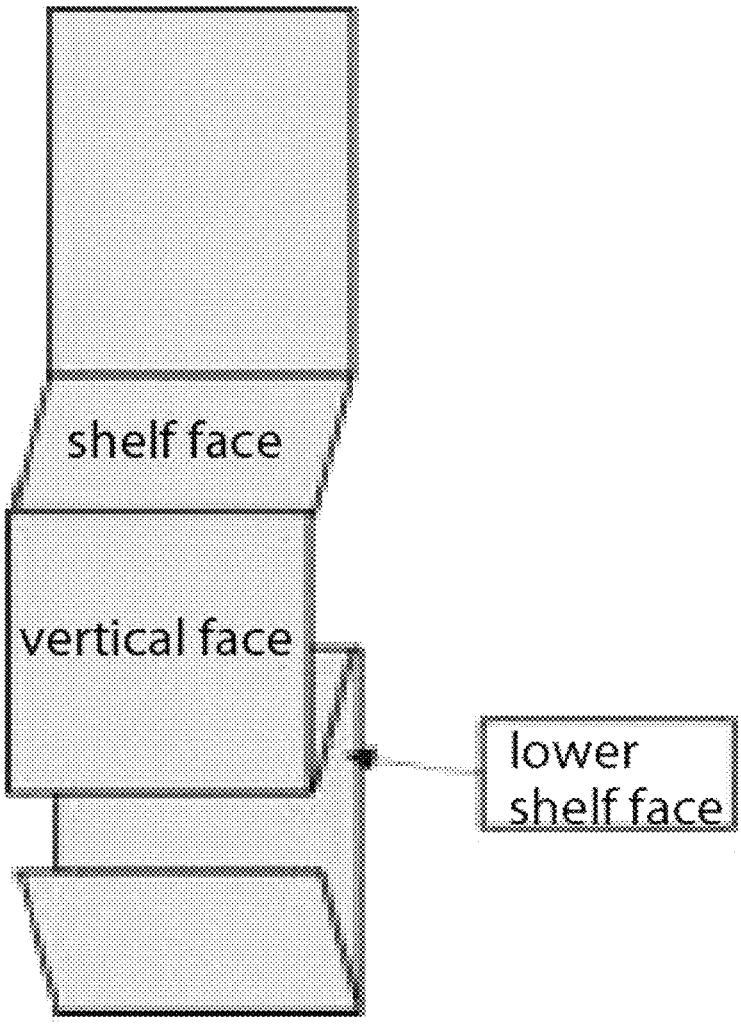
FIG. 5 is a view showing the shape of a bent cathode test piece (brass) used in Test Example 8, and a portion for which the number of micropores was measured.

Confirmation of Number of Micropores Depending on Specific Gravity of Watts Bath Microporous plated products were produced in the same manner as in Test Example 2 except that any of the microporous plating solutions prepared in Examples 16 to 19 was used as the microporous plating solution. The number of micropores (micropores/$cm^2$) was also measured in the same manner as in the Test Example. Note that in the Test Example, the evaluation face for which the number of micropores is measured was determined to be an upper shelf face, a vertical face, and a lower shelf face of a bent cathode test piece shown in FIG. 5. Further, a value obtained by subtracting the smallest number from the largest number of micropores of each of Examples 16 to 19 was defined as a range width. The results are shown in Table V.

TABLE 7

| | Example 16 | Example 17 | Example 18 | Example 19 |
|---|---|---|---|---|
| Number of micropores on upper shelf face (micropores/$cm^2$) | 78000 | 29614 | 32361 | 17219 |
| Number of micropores on vertical face (micropores/$cm^2$) | 34036 | 17487 | 18425 | 13065 |

TABLE 7-continued

| | Example 16 | Example 17 | Example 18 | Example 19 |
|---|---|---|---|---|
| Number of micropores on lower shelf face (micropores/$cm^2$) | 36716 | 22485 | 17688 | 13869 |
| Range width (micropores/$cm^2$) | 43964 | 12127 | 14673 | 4154 |

From Table 7, it was indicated that although there exists some variation, as the specific gravity of the Watts bath is higher, the range width becomes smaller and the variation in the number of micropores on the upper shelf face and the lower shelf face becomes smaller. That is, it was found that in order to obtain a uniform number of micropores in a complicated shape, it is preferred to set the specific gravity of the Watts bath high.

INDUSTRIAL APPLICABILITY

From the above, the present invention can be utilized in the production of automobile parts, faucet fittings, etc.

The invention claimed is:

1. A microporous plating solution, comprising nonconductive particles, polyaluminum chloride having a basicity of from 50 to 65, and a base plating solution, wherein the base plating solution is a Watts bath comprising from 240 g/L to 320 g/L of nickel sulfate.

2. The microporous plating solution according to claim 1, wherein the nonconductive particles comprise at least one selected from the group consisting of a nitride, a sulfide and an inorganic salt of silicon, barium, zirconium, aluminum, and titanium.

3. The microporous plating solution according to claim 1, further comprising a surfactant.

4. The microporous plating solution according to claim 3, wherein a content of the surfactant in the microporous plating solution is from 0.001 to 5 wt %.

5. The microporous plating solution according to claim 1, further comprising a brightener.

6. The microporous plating solution according to claim 1, wherein an average particle diameter of the nonconductive particles is from 0.1 to 10 μm.

7. The microporous plating solution according to claim 1, wherein a content of the nonconductive particles in the microporous plating solution is from 0.01 to 10 wt %.

8. The microporous plating solution according to claim 1, wherein a content of the polyaluminum chloride in the microporous plating solution is from 0.06 to 50.0 wt %.

9. The microporous plating solution according to claim 1, wherein the base plating solution has a specific gravity of from 1.0 to 1.6 g/$cm^3$.

10. A method for performing microporous plating on an object to be plated, the method comprising:

electroplating the object in the microporous plating solution of claim 1.

11. A method for controlling the number of micropores in plating, the method comprising:

changing a basicity of polyaluminum chloride contained in the microporous plating solution while performing electroplating on an object in the microporous plating solution of claim 1.

* * * * *